US005103564A

United States Patent [19]

MacDonald

[11] Patent Number: 5,103,564

[45] Date of Patent: Apr. 14, 1992

[54] SECTIONED CUTTING BLADE

[76] Inventor: Lea H. MacDonald, 327 McEwen Drive, Kingston, Ontario, Canada, K7M-3W2

[21] Appl. No.: 740,887

[22] Filed: Aug. 6, 1991

[51] Int. Cl.[5] ..... A26B 9/00

[52] U.S. Cl. ..... 30/351; 30/346.61; 76/104.1

[58] Field of Search ..... 30/346, 351, 346.61, 30/355, 346.56; 76/104.1

[56] References Cited

U.S. PATENT DOCUMENTS

| | | | |
|---|---|---|---|
| 2,123,768 | 7/1938 | Corsico-Piccolini et al. | 30/346.61 |
| 2,322,744 | 6/1943 | Benjamin | 30/346.61 |
| 4,729,168 | 3/1988 | Yeh | 30/346.61 X |

FOREIGN PATENT DOCUMENTS

| | | |
|---|---|---|
| 452882 | 11/1948 | Canada . |
| 1060194 | 8/1979 | Canada . |
| 1081934 | 7/1980 | Canada . |

*Primary Examiner*—Douglas D. Watts

*Attorney, Agent, or Firm*—Stevens, Davis, Miller & Mosher

[57] ABSTRACT

A cutting blade for use in cutting tools such as a carpet trimming device of hand knives is disclosed of the trapezoidal contour where the major base portion is the cutting edge and the blade is provided with a row of preferably three openings for a clamping screw. A series of scorelines perpendicular to the cutting edge and disposed centrally between the respective clamping openings enables the blade to be used both as a regular blade and broken into even or uneven blades to allow for selective adjustment of the cutting depth.

4 Claims, 2 Drawing Sheets

SECTIONED CUTTING BLADE

The present invention relates to cutting blades and in particular to cutting blades suitable for use in specialized tools, for instance in carpet trimming tools.

Various hand knives and other cutting tools are known having disposable cutting blades, among which the blades having the contour of a trapezoid are most popular. Blades of this shape have the advantage that they can be used with one acute angled tip projecting from the handle, while the opposite tip is within the handle, ready for use, when the first used tip becomes dull.

Many tools, particularly, but not exclusively, carpet trimming tools exist, in which the cutting blades are mounted on base. It is often a requirement that the depth of the cut by such tools be selectively adjustable to fit the particular workpiece to be cut. The depth of the cut is usually adjusted by adjusting the length at which the cutting edge of the blade projects beyond the mounting base of the tool.

It is further known, e.g. from Canadian Patent 1,060,194 issued Aug. 14, 1979 (Hepworth) to provide a hand knife having an elongated blade with oblique tip; the length of the blade section projecting from a handle is adjusted by a relatively complex sliding arrangement. The flat faces of the blade have a plurality of scorelines providing zones of weakness which can be broken to remove a worn tip of the blade and expose a fresh tip as and when required.

It is an object of the present invention to provide a blade for tools in which adjustment of the length of the blade is desirable which is simple in structure, preferably corresponding in shape to standard blades, but which may conveniently be used in cutting tool bases for strong and selective placement in a mounting base.

In general terms, the invention provides a cutting blade having generally planar opposed faces and a trapezoidal contour defined by a cutting edge coincident with a major base portion, a minor base portion parallel with the major base portion, and two end portions, each disposed at an acute angle to the major base portion and at an obtuse angle to the minor base portion, said acute and obtuse angles being the same for both end portions, said openings being disposed in a row generally parallel with said base portions, characterized in that at least one of the opposed faces is provided with score lines perpendicular to the bases and equidistantly spaced between each pair of adjacent ones of said openings, to provide zones of weakness whereby the blade may be broken to obtain two sections, each having at least one of said openings and having the shape of an irregular quadrangle having a major base section, an opposed minor base section, a first side at right angles to said base sections and a slanted side forming said acute and obtuse angles with the major and minor base sections, respectively.

The invention will be described by way of a preferred embodiment, with reference to the attached drawings, wherein.

Figure 1:
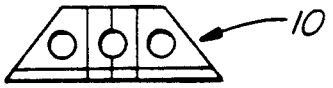
FIG. 1 is a plan view of a commercially available cutting blade on a 1:1 scale, modified in accordance with the present invention.
Figure 2:
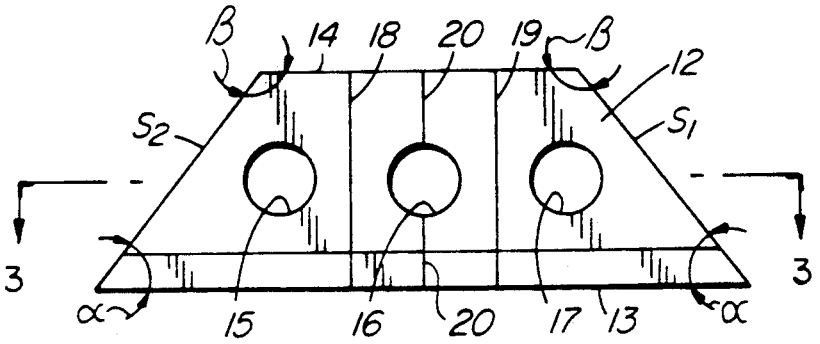
FIG. 2 is a view corresponding to FIG. 1 but being on a substantially enlarged scale for convenience.

The blade 10 of FIGS. 1 and 2 is a typical cutting blade used in many trades where clean and sharp cut is required, for instance in carpet cutting tools. It has two opposed, generally planar faces 11, 12. The contour of the blade is that of a trapezoid, where the cutting edge 13 forms a major base, the opposed, trailing edge 14 being the minor base and two opposed sides 15, 16 form the sides of the trapezoid. Both sides $S_1$, $S_2$ are at an acute angle $\alpha$ of about 55° to the major base 13 and at an obtuse angle $\beta$ of about 130° to the minor base 14. Three openings 15, 16 and 17 are disposed in a row parallel with the bases of the trapezoid as is well known. The number of the openings is optional but it is to be emphasized that the actual number is limited by practical considerations. Three openings are considered an optimum, among others, for reasons that commercials blades of this type already have the three openings.

According to the invention, a system of score lines is provided in both faces 11, 12 of the blade. The score lines are in coincidence across the thickness of the blade and are therefore referred to with the same reference numeral. The first score line 18 provides a linear line of weakness centrally between the openings 15, 16. A similar score line 19 is disposed between the openings 16, 17 and an optional score line 20 extends through the centreline of the blade, intersecting the opening 16 at a centreline thereof.

It is readily apparent that a number of options of breaking the blade of FIG. 2 exists. First, the break along the line 20, to produce two identical halves each including the half-opening of the hole 16 and with the screw receiving opening relatively remote from the backing edge produced at line 20. Another possibility is the breaking along lines 18 and 19, producing two identical, shorter blades, one with opening 15, the other with opening 17. And the breaking along one of the score lines 18 or 19 produces two blades of different lengths, one with one hole 15–16 or 16–17, the other with a single hole 17 or 15.

The last mentioned example presents a substantial advantage when it is desired to have two different depths of cut, such as happens in carpet trimming, where the required depth may be short if only the underside of a carpet is to be cut, to a greater depth when the pile of the carpet is to be cut also.

Figure 5:
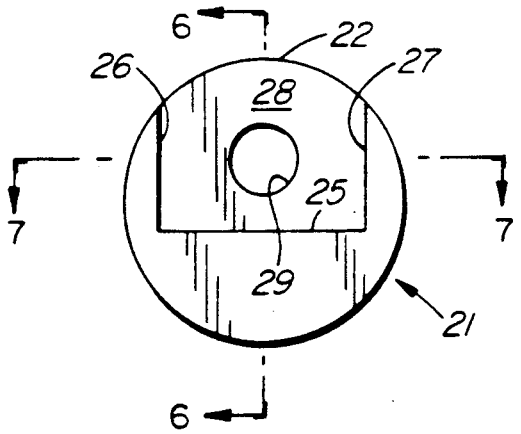
FIG. 5 is a view similar to that of FIG. 4, with the blade section removed.
Figure 6:
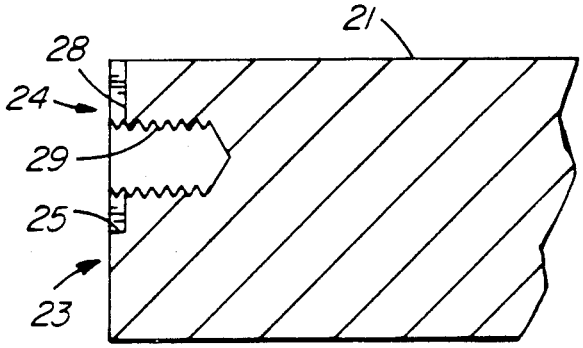
FIG. 6 is section 6—6 of FIG. 5.
Figure 7:
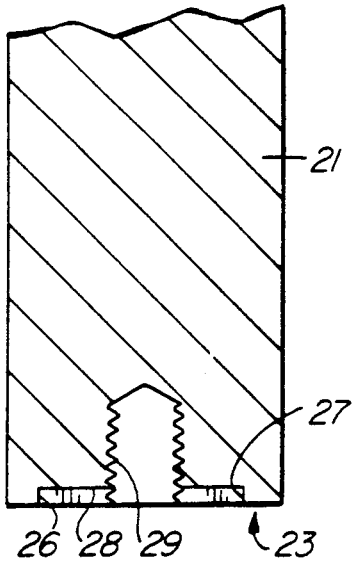
FIG. 7 is section 7—7 of FIG. 5.

FIG. 5 shows a part of a blade holder or base 21 of a cutting tool, for instance a carpet trimming tool. The base is of a generally cylidric configuration the top surface 22 of which is designed to slide underneath a carpet. The end face 23 of the base 21 is provided with a shallow rectangular recess 24 having a straight lower wall 25 and two straight, parallel side walls 26, 27. The bottom 28 of the recess 24 is flat. The depth of the recess 24 corresponds to the thickness of the blade 10 and the distance between side walls 26, 27 corresponds to the width of the blade 10 as measured between the major base 13 and the minor base 14. A threaded bore 29 is complementary with a blade fixing screw 30. The bore 29 is spaced from the lower wall 25 same distance as any of the holes 15–17 from the adjacent scorelines 18, 19.

Figure 3:
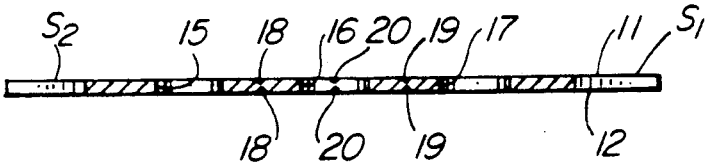
FIG. 3 is section 3—3 of FIG. 2.
Figure 4:
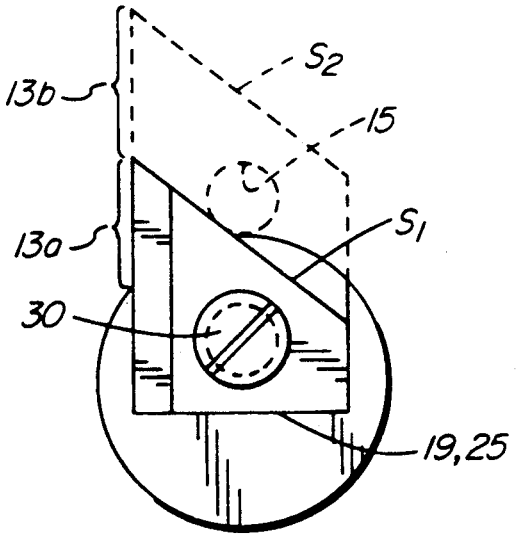
FIG. 4 is a diagrammatic representation of a section of the blade of FIG. 2 mounted in a blade support of a cutting tool.

Thus, if it is desired to provide two blades of different cutting length, the blade of FIGS. 2 and 3 is broken along the line 18 to provide a shallow cut blade shown in full lines of FIG. 4, wherein the blade clamping screw 30 passes through the hole 17 and the lower wall 25 coincides with the edge produced by the break along the former scorelines 19.

If the depth of the cut is to be increased, the second part of the blade, shown in broken lines, is used, with the clamping screw 30 engaging the opening 16. The length of the cutting edge is equal to 13*a* + 13*b*, whereas the shorter version only has the length of 13*a*.

Figure 8:
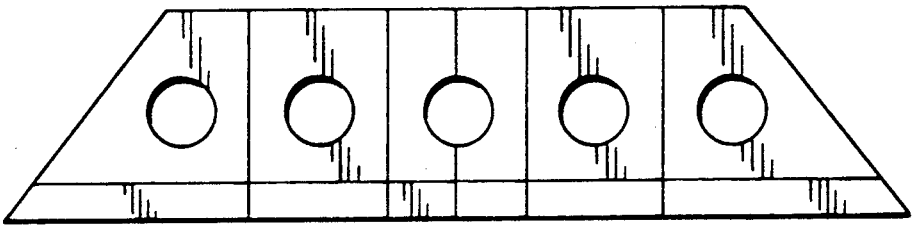
FIG. 8 is a view similar to that of FIG. 2 but showing a modified embodiment of the blade.

FIG. 8 is merely intended to show that, while the preferred embodiment of the invention is derived from a standard cutting blade, other types of blades can be used in providing advantages of the invention.

The application of the invention as described is in the art of carpet trimming. However, the invention is in no way limited to the particular use as it can be used in a great variety of other practical applications.

Accordingly, I wish to protect by letters patent which may issue on this application all such embodiments as properly fall within the scope of my contribution to the art.

I claim:

1. A cutting blade having generally planar opposed faces and a trapezoidal contour defined by a cutting edge coincident with a major base portion, a minor base portion parallel with the major base portion, and two end portions, each disposed at an acute angle to the major base portion and at an obtuse angle to the minor base portion, said acute and obtuse angles being the same for both end portions, said openings being disposed in a row generally parallel with said base portions, characterized in that at least one of the opposed faces is provided with score lines perpendicular to the bases and equidistantly spaced between each pair of adjacent ones of said openings, to provide zones of weakness whereby the blade may be broken to obtain two sections, each having at least one of said openings and having the shape of an irregular quadrangle having a major base section, an opposed minor base section, a first side at right angles to said base sections and a slanted side forming said acute and obtuse angles with the major and minor base sections, respectively.

2. A cutting blade as claimed in claim 1, wherein the number of the openings is an uneven number, whereby the blade can be broken into two parts having uneven length of said base sections.

3. A cutting blade as claimed in claim 1, further including a central score line or score lines extending centrally of said bases at right angles thereto, whereby the said two parts may be of a generally even size and configuration.

4. A cutting blade as claimed in claim 2, wherein the number of said openings is three, further comprising a central score-line interrupted by a central one of the three openings, whereby the blade can be selectively broken into two generally equal halves or into said two parts having uneven length of said base sections, to define a short subsection of the blade and a long subsection of the blade, said short subsection having one of said openings, the long subsection having two of said openings.

* * * * *

UNITED STATES PATENT AND TRADEMARK OFFICE

CERTIFICATE OF CORRECTION

PATENT NO. : 5,103,564

DATED : April 14, 1992

INVENTOR(S) : Lea H. MacDonald

It is certified that error appears in the above-identified patent and that said Letters Patent is hereby corrected as shown below:

Column 3, line 33, (Claim 1, line 8), delete "said".

Signed and Sealed this

Fifth Day of October, 1993

Bruce Lehman

*Attest:*

BRUCE LEHMAN

*Attesting Officer*

*Commissioner of Patents and Trademarks*